US009593676B2

(12) United States Patent
Vanconett

(10) Patent No.: US 9,593,676 B2
(45) Date of Patent: Mar. 14, 2017

(54) RECTANGULAR PUMP ATTACHMENT INTERFACE PROVIDING A PORTABLE FIXED LINK BETWEEN A PUMP LINE COUPLED TO A MOBILE TANK AND A LINE DISPOSED IN A RESERVOIR

(71) Applicant: Randal K. Vanconett, Grand Junction, CO (US)

(72) Inventor: Randal K. Vanconett, Grand Junction, CO (US)

( * ) Notice: Subject to any disclaimer, the term of this patent is extended or adjusted under 35 U.S.C. 154(b) by 78 days.

(21) Appl. No.: 14/160,508

(22) Filed: Jan. 21, 2014

(65) Prior Publication Data

US 2014/0130897 A1 May 15, 2014

Related U.S. Application Data

(63) Continuation-in-part of application No. 13/013,343, filed on Jan. 25, 2011, now Pat. No. 8,631,815.

(51) Int. Cl.

| | |
|---|---|
| ***F04B 23/02*** | (2006.01) |
| ***F04B 53/16*** | (2006.01) |
| ***F04B 17/06*** | (2006.01) |

(52) U.S. Cl.

CPC ..... *F04B 23/02* (2013.01); *F04B 17/06* (2013.01); *F04B 23/025* (2013.01); *F04B 53/16* (2013.01); *Y10T 137/5762* (2015.04)

(58) Field of Classification Search

CPC ..... Y10T 137/402; Y10T 137/5762; Y10T 137/6966; Y10T 137/85978;

(Continued)

(56) References Cited

U.S. PATENT DOCUMENTS 3,562,969 A * 2/1971 Little, Jr. ..... 52/20
3,613,894 A 10/1971 Clegg (Continued)

FOREIGN PATENT DOCUMENTS

EP 0372963 A1 6/1990
EP 0439890 A1 8/1991

(Continued)

OTHER PUBLICATIONS

Website: http://pubs.acs.org/doi/pdf/10.1021/es00107a011 Patrick J. Setsen, Norma L. Guinasso, Jr., Neil L. Condra, Denis A. Wiesenburg, and David R. Schink; A Deep-Towed Pumping System for Continuous Underway Sampling; Environ. Sci. Technol. vol. 17, 1883, p. 47.

*Primary Examiner* — Michael R Reid
(74) *Attorney, Agent, or Firm* — Russ Weinzimmer & Associates, PC

(57) ABSTRACT

A portable and relocateable pump attachment interface provides a fixed link between a first line in communication with a fluid reservoir, and a second line in communication with a mobile storage tank via a pump of a pump truck. The interface includes an interface body that supports a fixed conduit entirely above ground. The front end of the conduit is for coupling to the first line, and the back end of the conduit is for coupling to the second line. The interface body has a fitting access space and a spill containment catch basin disposed under the fitting access space, and the second end of the conduit is located within the fitting access space and over the spill containment basin to catch any spillage from the second line when it is coupled to and uncoupled from the conduit. The interface body can be a concrete block, or be molded plastic filled with sand or water and is massive enough to substantially isolate line one from line 2. A metal (Continued)

conduit cover controls access to the front end of the conduit by enclosing the fixture access space.

20 Claims, 9 Drawing Sheets

(58) Field of Classification Search
CPC .... Y10T 137/7069; F04B 23/02; F04B 17/06; F04B 53/16; F16K 35/06
USPC ..... 137/565.01, 590, 356, 236.1, 312, 383; 405/36
See application file for complete search history.

(56) References Cited

U.S. PATENT DOCUMENTS

| | | | | |
|---|---|---|---|---|
| 3,690,463 | A | 9/1972 | O'Brien | |
| 3,734,138 | A | 5/1973 | Brown et al. | |
| 3,778,948 | A | 12/1973 | Berthier | |
| 4,019,830 | A | 4/1977 | Reid | |
| 4,138,042 | A | 2/1979 | Okada | |
| 4,179,379 | A | 12/1979 | Mitchell | |
| 4,180,348 | A | 12/1979 | Taylor | |
| 4,449,849 | A | 5/1984 | Horn et al. | |
| 4,659,293 | A | 4/1987 | Evenson | |
| 4,703,785 | A * | 11/1987 | Antos | B65D 47/063 138/109 |
| 4,874,133 | A | 10/1989 | Gethke et al. | |
| 5,082,013 | A | 1/1992 | Scheib | |
| 5,108,591 | A | 4/1992 | Hagan | |
| 5,137,064 | A * | 8/1992 | McGarvey et al. | 141/198 |
| 5,255,999 | A | 10/1993 | Perslow | |
| 5,299,709 | A | 4/1994 | Beerbower et al. | |
| 5,311,909 | A | 5/1994 | Adcock | |
| 5,392,806 | A | 2/1995 | Gallant | |
| 5,470,011 | A | 11/1995 | Jordan | |
| 5,509,437 | A | 4/1996 | Merrett | |
| 5,511,573 | A * | 4/1996 | Corte | 137/15.16 |
| 5,527,130 | A | 6/1996 | Webb | |
| 5,618,166 | A | 4/1997 | Leggett et al. | |
| 5,624,241 | A | 4/1997 | Nesseth | |
| 5,647,412 | A | 7/1997 | Brewer | |
| 5,687,434 | A * | 11/1997 | Tagg | E03B 11/04 4/624 |
| 5,797,421 | A | 8/1998 | Merrett | |
| 5,955,657 | A | 9/1999 | Bravo | |
| 6,000,428 | A | 12/1999 | Berberat | |
| 6,019,242 | A * | 2/2000 | Wysocki et al. | 220/571 |
| 6,308,753 | B1 | 10/2001 | Nimberger et al. | |
| 6,386,049 | B1 | 5/2002 | Schrumm | |
| 6,619,596 | B1 | 9/2003 | Caine et al. | |
| 6,698,461 | B1 | 3/2004 | Bryan et al. | |
| 6,701,982 | B1 | 3/2004 | Ortiz et al. | |
| 6,988,874 | B2 | 1/2006 | Spargo | |
| 7,107,406 | B2 | 9/2006 | Kurasugi | |
| 7,195,284 | B2 | 3/2007 | Garton et al. | |
| 7,299,822 | B2 | 11/2007 | Wall | |
| 7,575,677 | B1 | 8/2009 | Barnes | |
| 7,604,710 | B2 | 10/2009 | Haslem et al. | |
| 7,673,658 | B1 * | 3/2010 | Brewer et al. | 141/86 |
| 8,631,815 | B2 * | 1/2014 | VanConett | 137/312 |
| 2004/0056030 | A1 * | 3/2004 | Coppedge et al. | 220/4.23 |
| 2007/0210215 | A1 | 9/2007 | Prest | |
| 2008/0061010 | A1 | 3/2008 | Tom | |
| 2008/0223468 | A1 | 9/2008 | Stegall | |
| 2008/0283623 | A1 | 11/2008 | Haslem et al. | |
| 2010/0083440 | A1 * | 4/2010 | Spurlock | A47J 47/20 4/658 |
| 2010/0200516 | A1 | 8/2010 | Hwang | |

FOREIGN PATENT DOCUMENTS

| | | | |
|---|---|---|---|
| EP | 0508680 | A1 | 4/1992 |
| EP | 0486168 | A1 | 5/1992 |
| EP | 1939392 | A2 | 12/2006 |
| EP | 2175071 | A1 | 4/2010 |
| GB | 2426310 | A | 11/2006 |
| JP | 07132513 | A2 | 5/1995 |
| JP | 09110360 | A2 | 4/1997 |
| JP | 10306417 | A2 | 11/1998 |
| JP | 2007145669 | A2 | 6/2007 |
| JP | 2009174196 | A | 8/2009 |
| WO | 2005088071 | A1 | 9/2005 |
| WO | 2007030841 | A1 | 3/2007 |

* cited by examiner

RECTANGULAR PUMP ATTACHMENT INTERFACE PROVIDING A PORTABLE FIXED LINK BETWEEN A PUMP LINE COUPLED TO A MOBILE TANK AND A LINE DISPOSED IN A RESERVOIR

CROSS-REFERENCE TO RELATED APPLICATIONS

The present application is a continuation-in-part, and claims the benefit of and priority to, U.S. patent application Ser. No. 13/013,343 entitled "PUMP ATTACHMENT INTERFACE PROVIDING A FIXED LINK BETWEEN A PUMP LINE COUPLED TO A MOBILE TANK AND A LINE DISPOSED IN A RESERVOIR," filed Jan. 25, 2011 and which application is fully incorporated herein in its entirety by this reference.

FIELD OF THE INVENTION

This invention relates to providing water at remote locations for purposes such as drilling oil and gas wells and fighting forest fires, and more particularly to facilitating the transport of the water to and from temporary storage ponds or drill pits located at the remote locations by way of pump trucks.

BACKGROUND OF THE INVENTION

Very large quantities of water are required to support oil and gas well drilling operations. Because the drilling sites are often located in remote and dry areas, water must be transported to the drilling sites at significant expense. The water is typically brought to a location that is near or central to a number of drilling sites using several pump trucks, and then stored in man-made ponds often referred to as drill pits. Pump trucks are then used to pump water from the drill pit and to transport the water to a particular drill site as needed to support the drilling operation. To minimize expense, the water is typically recovered during the drilling operation and returned by the pump truck back to the drill pit for future use at that or other drilling sites. The water from one drill pit may even be moved to another drill pit when, for example, operations are winding down at one location but are ramping up at another.

Drilling operations are very dirty, and the recovered water is typically contaminated with chemical byproducts and hydrocarbons associated with the drilling process. Drill pits therefore have recently fallen under severe scrutiny by various environmental regulatory agencies. A number of precautionary measures must be taken to comply with environmental regulations established by those agencies, and to ensure that the recycled water does not contaminate the surrounding ecosystem or otherwise harm wildlife.

One requirement is that the drill pits be lined to prevent the contaminated water from seeping into the ground and eventually contaminating the groundwater. Another requirement is that the drill pits be covered with netting to prevent wildlife from attempting to access the water either for drinking, bathing, or especially in the case of waterfowl, just landing.

Typically, a pump truck is dispatched to either deliver water to a drill pit or to draw water therefrom. The operator backs the truck up to the drill pit, pulls out a line (usually a hose or some form of flexible tubing) that is in communication with the tank of the pump truck through a pump, and the operator casts the free end of the line into the drill pit.

This process is often made more difficult in that the line must be first disposed through the protective netting. This makes access to the water more difficult and can cause damage to the netting.

The end of the line also tends to be dragged across the bottom of the pond, especially during withdrawal of the line by the operator. This can cause further damage to the netting, and to the protective liner at the bottom of the pit. As the line is removed from the pit and refracted for transport, it is dragged across the ground and water remaining in and on the line can contaminate the ground surrounding the pit. Sometimes the operator forgets that the line is still in the drill pit and starts to drive off without first removing the line, causing the end of the line to drag along the pit liner, as well as to spill water remaining in the line onto the ground as it emerges from the pond or drill pit.

Lines are sometimes left at the drill pit on a semi-permanent basis, one end disposed through the netting and into the drill pit, the other end left lying on the ground to which the pump truck lines can be coupled. This eliminates having operators constantly deploying and withdrawing their pump lines into and out of the drill pits. These lines are not, however, secure and as a result, persons looking to dump waste water could access the drill pit for unauthorized dumping of waste water, or to draw contaminated water for unauthorized purposes.

Moreover, an operator does not always position a truck with enough slack, because it is hard to tell where the end of the line is and how much slack is available in that line from inside the truck. Thus, the operator is sometimes tempted to pull on the line disposed in the drill pit to create the necessary slack to facilitate the coupling of the pump truck line to the end left on the ground. Operators also can and still do forget to decouple their truck's pump line from the line disposed in the pit and start to pull away. The end of the line in the pit can be dragged across the pond liner, potentially causing damage to the pit liner and therefore leaks of the contaminated water.

Finally, there is still a significant likelihood that spillage of contaminated water, remaining in the hoses after the pumping process is complete, will occur when the operator connects or disconnects the pump truck line from the line disposed in the pond or drill pit. This can and does lead to environmental contamination of the area around the pond or drill pit in violation of environmental regulations.

Known prior art implementations of attachment links made to bodies of water for purposes such as fire-fighting, are not concerned with the environmental issues of contaminated water. Moreover, those bodies of water are typically permanent rather than temporary as in the case of drill pits. Thus, known attachment links are typically at least partially if not wholly buried and anchored underground and thus not easily re-located. Such known attachment links are therefore not a suitable solution for drill pits that are created for temporary use, or for which operations are commonly rotated among a plurality of remote sites.

SUMMARY OF THE INVENTION

A pump attachment interface provides a fixed link between a line having one of its ends permanently or semi-permanently disposed in a pond or drill pit and a pump line through which water can be pumped into or out of a mobile reservoir, such as a tank mounted on a pump truck. The pump attachment interface provides a fixed connection target for the operator of a pump truck to back up to and to which to connect and disconnect the pump line. This is accomplished by disposing a conduit on or within a rectangular shaped interface body that can be either horizontal or at an angle so that the upper connection to which the pump truck line is to be connected is elevated up off of the ground and at height that is easy to see from the cab and easy to reach. The lower connection of both the horizontal and the angled conduit is also elevated from the ground for easy connection to the line disposed in the pit or pond.

The interface body provides enough mass and weight to render the elevated connection point substantially stable in the environment in which the interface is deployed, yet remains portable such that it may be easily relocated to other sites. The mass and weight of the interface body also resists movement if bumped by pump trucks backing up to it, or if pulled by operators attempting to pull away before the pump truck line has been disengaged from the conduit of the interface. These features help to reduce, if not eliminate, any breaches in the required netting over the drill pit, and/or in the liner at the bottom of the drill pit or pond.

The pump attachment interface can further include a spill containment catch basin that is disposed in a manner at the upper connection end of the fixed link such that any spillage of contaminated water that may occur when the operator is coupling or decoupling the pump truck hose from the elevated connection is spilled into the catch basin. This feature significantly reduces, if not eliminates the possibility of environmental contamination of the ground area near the perimeter of the drill pit or pond. An automated vacuum mechanism is provided that permits spillage in the catch basin to be vacuumed into the conduit as fluid flows through the conduit.

The conduit is protected by a hinged metal cover and a locking mechanism to prevent unauthorized access to the link. The rectangular shape permits easy stacking when not in use.

In an embodiment, a portable pump attachment interface provides a relocateable fixed link between a first line in communication with a fluid reservoir and a second line in communication with a mobile storage tank via a pumping mechanism. The attachment interface includes an interface body having a substantially rectangular shape and has a bottom surface for resting upon the surface of the ground, a conduit supported by the interface body to elevate and support the entire conduit above the ground, a back end of the conduit configured to be coupled to the first line, and a front end of the conduit configured to be coupled to the second line. The attachment interface also includes a spill containment catch basin formed under a fitting access space formed in a top surface of the interface body, the front end of the conduit being disposed over the spill containment catch basin and disposed within the fitting access space. The interface body is configured to substantially isolate the first line from pulling forces exerted on the second line.

In an embodiment, the interface body is made of solid concrete so that it has sufficient weight to substantially isolate the first line from pulling forces exerted on the second line.

In another embodiment, the pump attachment interface also includes a vacuum mechanism coupled between the conduit and the catch basin for removing spillage from the catch basin.

In a further embodiment, the vacuum mechanism includes a vacuum valve coupled between the conduit and a vacuum line disposed in the catch basin, the flow of liquid through the conduit causing a vacuum within the vacuum line when the vacuum valve is open.

In yet another embodiment, the conduit is angled and supported by a sloping surface within a conduit space integrally formed within the sloping surface so that the front end of the conduit is at a higher level above the ground than the back end of the conduit.

In another embodiment, the interface body is made of hollow molded plastic and is configured to be filled with a weighting material such that the interface body has sufficient weight to substantially isolate the first line from pulling forces exerted on the second line.

In another embodiment, the conduit is substantially straight and supported by a conduit channel formed within a top surface of the interface body so that the front end of the conduit is at substantially the same height above the ground as the back end of the conduit.

In other embodiments, the spill containment catch basin is integrally formed with the interface body.

In another embodiment, the pump attachment interface includes a conduit cover that encloses the fitting access space when closed. The conduit cover can include a locking mechanism to prevent unauthorized access to the fitting access space and the front end of the conduit. The conduit cover may also include a hinge between a first and a second plate, the first plate and second plate capable of being hingedly opened independently of the other.

In yet another embodiment, the bottom surface of the interface body includes lift channels for receiving fork lift blades on each side of the interface body. A front surface of the interface body can also include at least one recess for receiving a bollard that is disposed in the ground upon which the bottom surface of the interface body rests.

BRIEF DESCRIPTION OF THE DRAWINGS

The invention will be more fully understood with reference to the Detailed Description, in conjunction with the following figures, wherein.

DETAILED DESCRIPTION

Figure 1A:
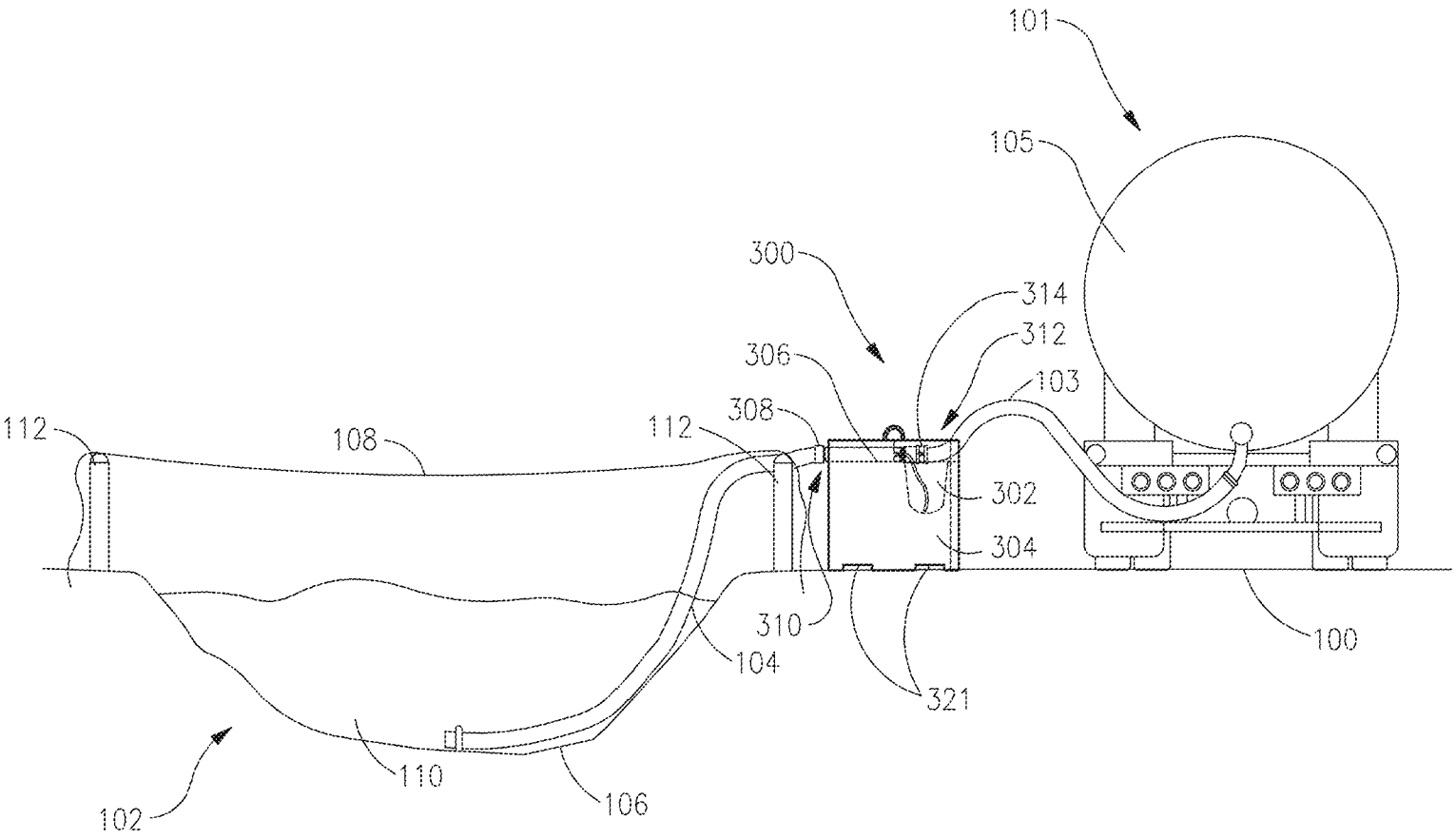
FIG. 1A is a perspective view of a pond or drill pit having one end of a line disposed therein, a first embodiment of the invention providing a fixed link thereto coupled to the other end of the line, and further providing a coupling to a pump line of a pump truck.

FIG. 1A illustrates a typical environment in which a first embodiment of the pump attachment interface 300 might be deployed. A cross-sectional view of a pond or drill pit 102 is shown, containing water 110 and covered by protective net 108 as supported by support members 112. Pond or drill pit 102 has a protective liner 106 that lines the bottom of drill pit 102 to prevent the water 110 from escaping into the ground. One end of a first line 104 is semi-permanently disposed through the netting (not shown) and into the pit 102, the other end being coupled to a back end 310 of a conduit 306 of the portable attachment interface 300 at coupling 308.

In an embodiment, the conduit 306 is shown supported by a substantially horizontal elevated surface of interface body 304. The front end 312 of conduit 306 is shown having a coupling 314 disposed above a spill containment catch basin 302. Attachment interface 300 rests upon the surface of the ground 100, and is easily elevated for relocation using a fork lift and lift channels 321.

A second line, pump line 103 of pump truck 101, is coupled to the upper coupling 314 of the fixed link of the invention 300. The pump line 103 is typically connected to tank 105 of pump truck 101 through a pumping mechanism (not shown). Water 110 can be pumped from the drill pit 102 and into tank 105 of pump truck 101, or from the tank 105 and back into drill pit 102, all through the fixed link of the invention 300.

Figure 1B:
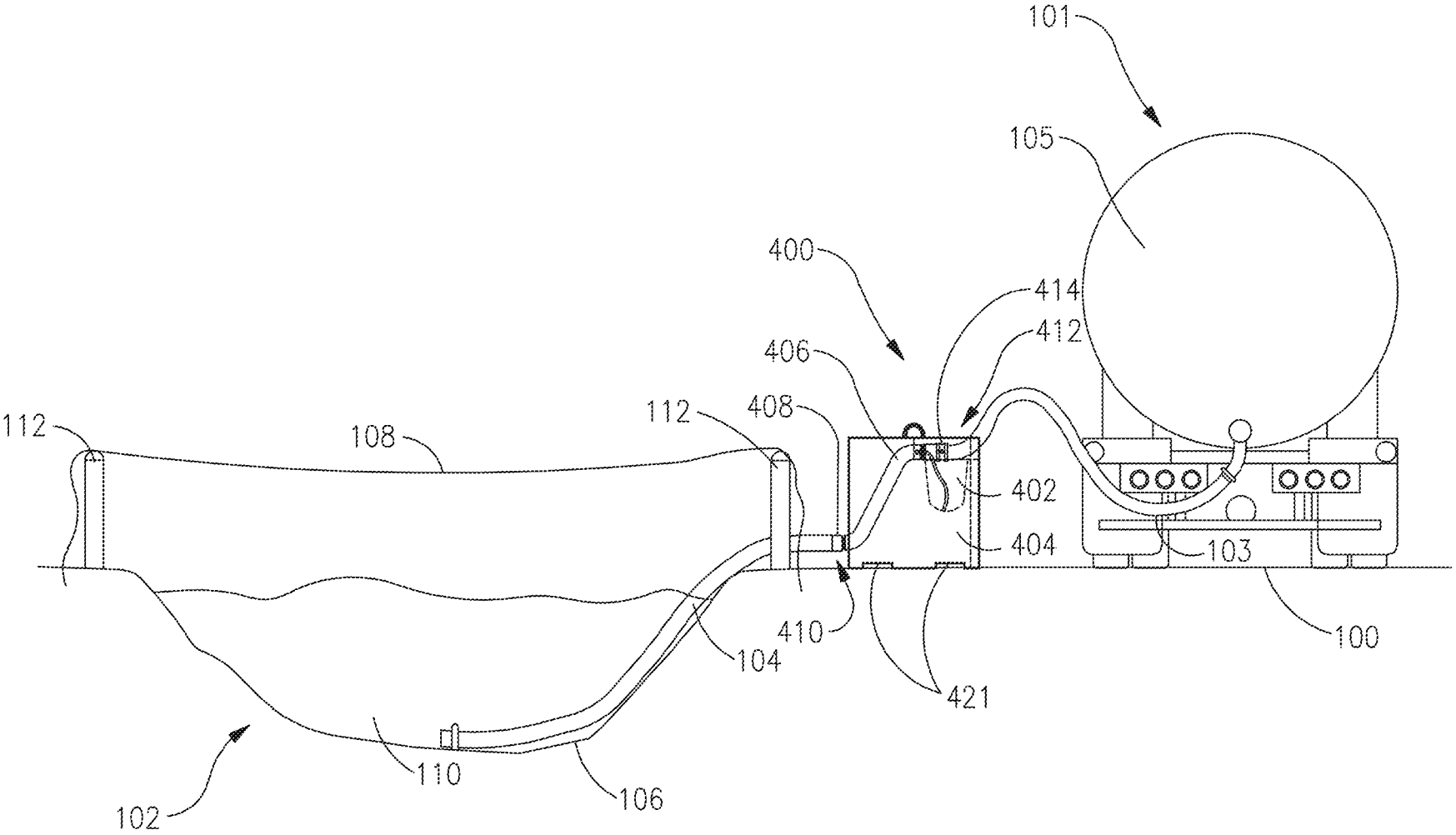
FIG. 1B is a perspective view of a pond or drill pit having one end of a line disposed therein, a second embodiment of the invention providing a fixed link thereto coupled to the other end of the line, and further providing a coupling to a pump line of a pump truck.

FIG. 1B illustrates the same environment as FIG. 1A, in which a second embodiment of the pump attachment interface 400 might be deployed. One end of a first line 104 is semi-permanently disposed through the netting 108 and into the pit 102, the other end being coupled to a back end 410 of a conduit 406 of the portable attachment interface 400 at coupling 408. In an embodiment, the conduit 406 is shown supported by a sloped surface internal to interface body 404. The front end 412 of conduit 306 is elevated by the sloped surface to a level substantially above the back end 410 and is shown having a coupling 414 disposed above a spill containment catch basin 402. The sloped surface of the interface body 404 stops before reaching the ground, thereby elevating the back end 410, and coupling 408 of the conduit 406 off of the ground 100 as well. Attachment interface 400 is completely above and resting on ground 100, and is easily lifted therefrom for relocation by way of lift channels 421.

Figure 2A:
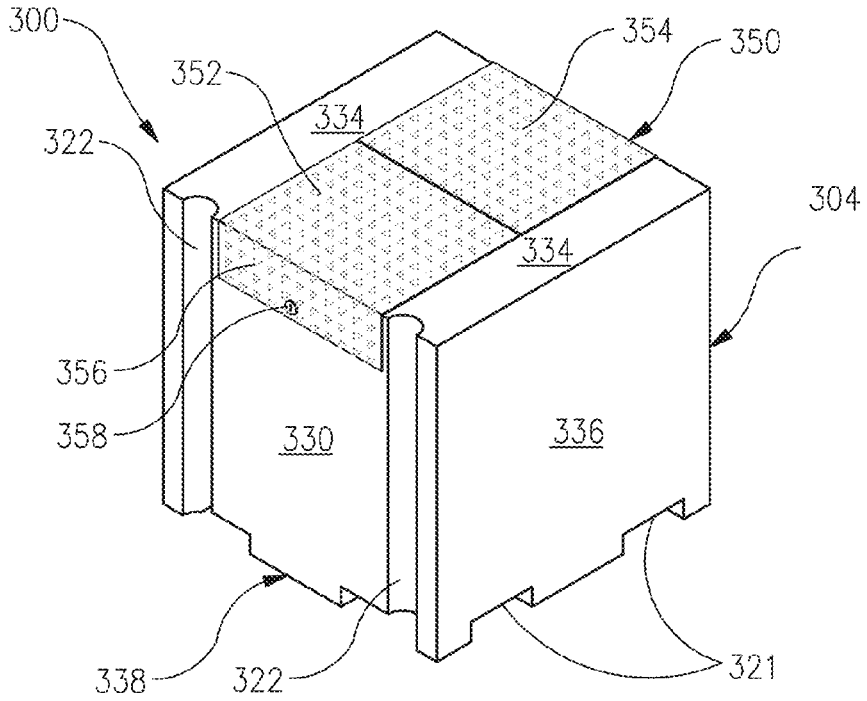
FIG. 2A is an oblique view of the front end of an embodiment of the invention when it is closed and locked up.

FIG. 2A is a view showing an oblique view of the front of attachment interface 300 when it is in a closed and locked configuration. Those of skill in the art will recognize that attachment interface 300 will have the same appearance as for attachment interface 400 from this perspective. Access to the front end 312 of conduit 306 is completely prevented by conduit cover 350, which can be locked using any known locking mechanism 358, such as a keyed entry, a combination entry, padlock or the like. Those of skill in the art will recognize that that any well-known locking mechanism can be used in combination with cover 350 to prevent unauthorized access to the front end 312 of conduit 306. Conduit cover 350 may be made of any appropriate material, including metal such as stainless steel or non-corrosive aluminum. It can be fixedly secured to the top surface 334 of interface body 304 at hinge point 356

In an embodiment, the conduit 306 is shown supported by a substantially horizontal elevated surface of interface body 304. The front end 312 of conduit 306 is shown having a coupling 314 disposed above a spill containment catch basin 302. The sloped conduit channel 320 of the interface body 304 stops before reaching the ground, thereby elevating conduit 306 off of the ground 100 as well. Attachment interface 300 rests upon the surface of the ground 100, and is easily elevated for relocation using a fork lift and lift channels 321.

Figure 2B:
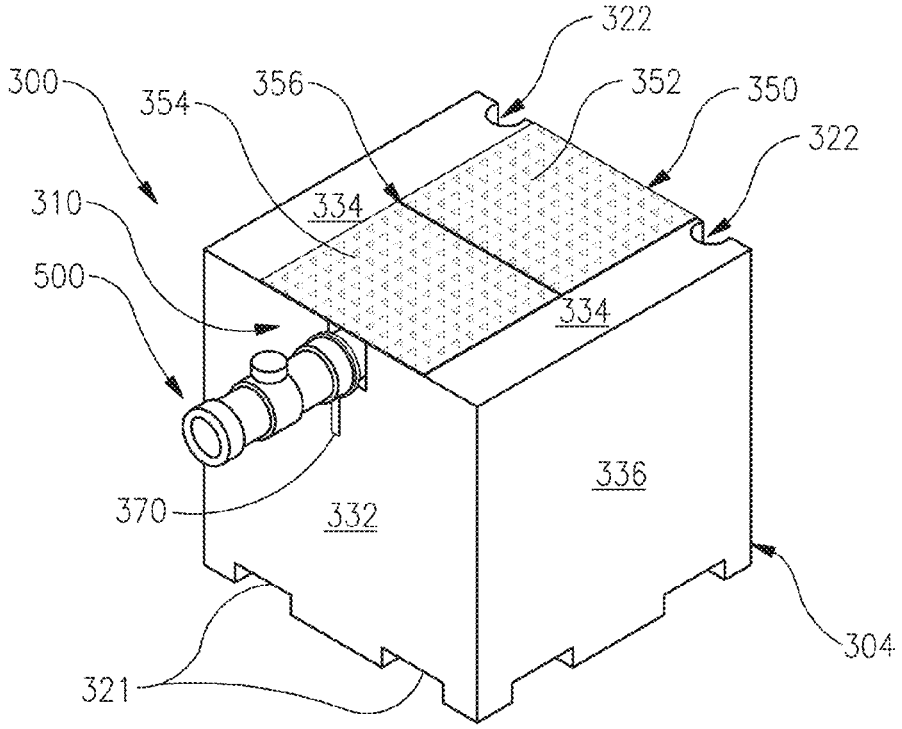
FIG. 2B is an oblique view of the back end of an embodiment of the invention when it is closed and locked up.

FIG. 2B is a view showing an oblique view of the back of attachment interface 300 when it is in a closed and locked configuration. Those of skill in the art will recognize that the back of attachment interface 300 will have the same appearance as for the back of attachment interface 400 from this perspective, except that the exit opening for the coupling 408 at the back end 412 of conduit 406 from the back surface of interface body 404 will be at a lower point above ground 100 than that of interface body 304 of the first embodiment attachment interface 300. Strap 370 can be attached to the back surface 332 of interface body 304 and coupled to the back end 310 of conduit 306 to hold conduit 306 in place. The back half of conduit 306 is covered by back plate 354 of conduit cover 350. FIG. 2B shows a check valve coupling 500, which can prevent the back-flow of water through conduit 306 in the event that the line a failure occurs that would otherwise cause such back-flow to occur. Those of skill in the art will recognize that other such devices can also be used, such as a back-flow preventer, and the like.

Figure 3A:
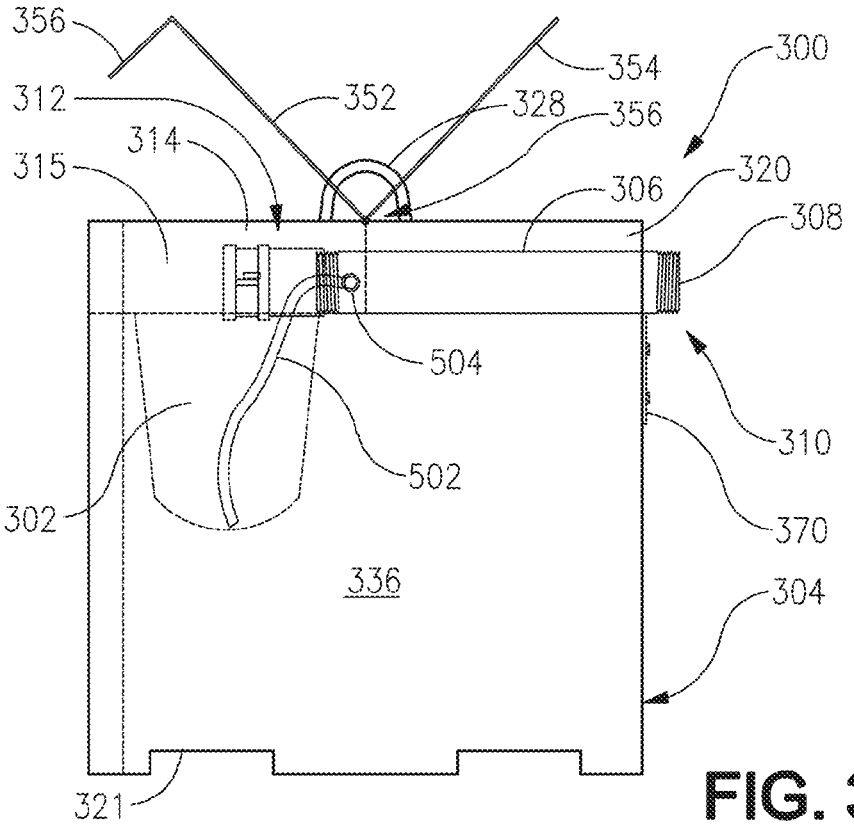
FIG. 3A is a side view of a first embodiment of the invention.

FIG. 3A is a diagram showing a side view of the first embodiment of the invention 300. Various internal components have been revealed in this view for illustrative purposes. Interface body 304 has a substantially horizontal surface formed by channel 320 that can be rounded to fit conduit 306. In an embodiment, the interface body 304 can be a cement block consisting of approximately one cubic yard of six sack concrete with fibermesh and can weigh approximately 3400 pounds. The weight and mass of the attachment interface 300 therefore provides a stable platform that can serve to isolate the semi-permanently disposed first line 104 (FIG. 1) from being pulled by the operator or the operator's truck. Attachment interface 300 therefore also provides a stable and elevated target for the pump truck operator to back up to. The front end 312 of the conduit 306 is also at a height that provides easy access to the operator.

In an alternate embodiment, the interface body 304 can be made of a substantially non-reactive molded plastic or other suitable material that is corrosion resistant or substantially non-reactive. Because plastic does not provide the weight of concrete, the interface body 304 of such an embodiment can be hollow and filled with a weighting material such as water, sand, or any other suitable material by which to provide sufficient weight for stability of the attachment interface 300. In an embodiment, a fill plug 380*a*, FIG. 3D can be located in the top surface 334 that can be opened and used to introduce the weighting material interface to the body 304. A drain plug 380*b*, FIG. 3D located near the bottom of the interface body can be opened to drain the weighting material from the interface body 304 to make it easier to move. It will be obvious to those of skill in the art that additional plugs or other well-known means can be employed to fill and drain the interface body 304 of suitable weighting material.

Conduit 306 is at least partially supported by the horizontal channel surface 320 and can be secured thereto by strap 370. In an embodiment, the conduit 306 can be disposed inside of channel 320 such that the conduit 306 is substantially recessed inside of channel 320 as illustrated. This permits the back plate 354 to completely cover conduit 306 and lie flush and even with top surface 334.

In an embodiment, the conduit 306 can be made of a non-corrosive material such as aluminum. The conduit can be of a suitable diameter, such as four inches. In an embodiment, the width of the channel 320 can be just larger than the diameter of conduit 306 so that once conduit 306 is seated within channel 320 through slight deformation of the diameter of the conduit 306, the sides of channel 320 provide additional gripping force to help clamping means 370 retain the conduit 306 in channel 320. Clamping means 370 can be any suitable structure that might be employed to retain conduit 306 within channel 230, including a strap bolted to the back surface 332 of interface body 304 as shown, or brackets, ties, clamps, etc.

In an embodiment, the front end 312 of conduit 306 extends from channel 320 into fitting access space 315 and over a spill containment space 302. Fitting access space 315 is deep enough to permit easy access to fitting 308 to facilitate coupling thereto decoupling therefrom, and allows front plate 352 of cover 350 to be flush and substantially even with top surface 334 when closed. Guard plate 356 extends perpendicularly to the front surface 330 from front plate 352 by a distance that is substantially equal to the depth of the fitting access space 315. Guard plate 356 thereby encloses the front of the fitting access space 315 that extends into the front surface 330 of interface body 304.

Spill containment space 302 is integrally formed within interface body 304 and is of sufficient size to either form a spill containment catch basin itself, or to receive a spill containment catch basin component therein (not shown) that can be removably disposed under fitting 314 and within spill containment space 302. Spill containment space/basin 302 is disposed to catch any water that may spill from the pump line 103 as it is coupled and/or decoupled from the fitting 314. A catch basin component can be of any design, such as the "Pumpkin" spill containment system manufactured by Renegade Oilfield Products, LLC in Beaumont, Tex. Those of skill in the art will recognize that for embodiments where the spill containment space serves as the spill containment basin, it may be lined with a non-reactive material such as aluminum or stainless steel.

A vacuum line 502 is disposed into the catch basin 302 and is coupled to conduit 306 through a control valve 504. A truck operator can open the control valve 504 while pumping water through the conduit 306, into or out of pit 102, to create a vacuum that will vacuum out any spilled water that has been collected into the basin through line 502 and into conduit 306. Thus, spillage of contaminated water into the catch basin 302 can be easily removed without it being necessary to handle the water in any way manually.

Figure 3B:
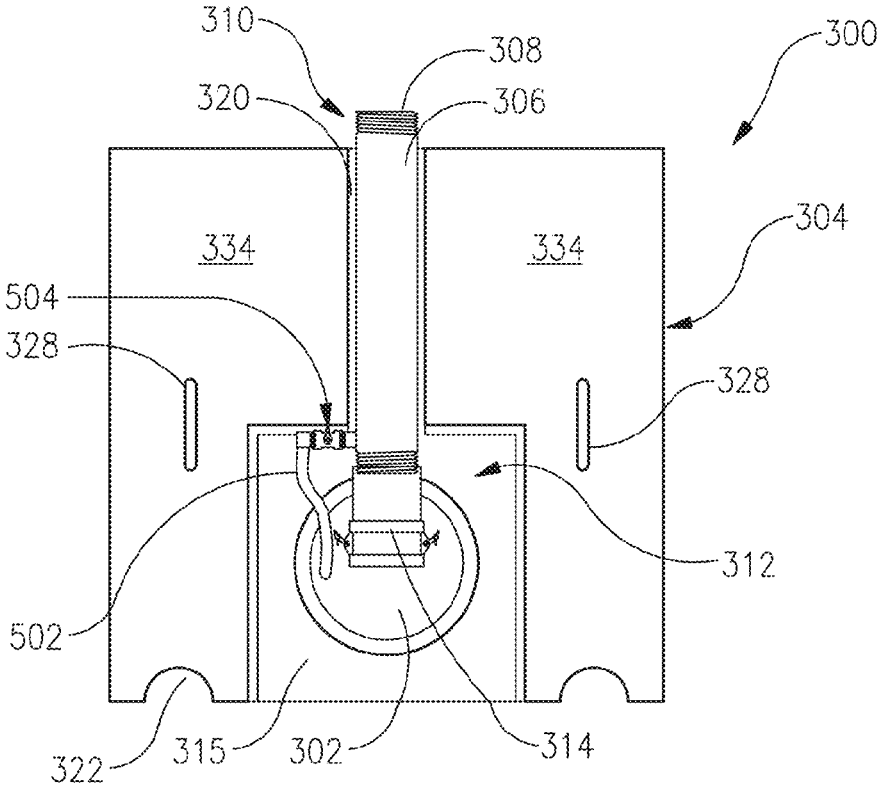
FIG. 3B is a plan view of the top of the first embodiment of the invention.

FIG. 3B shows a plan view of the top of an embodiment of the pump attachment interface 300. The cover 350 has been removed for convenience of illustrating the components therein. Interface body 304 is shown, having top surface 334. The conduit channel 320 starts at the back surface 332 of the interface body 304 and runs toward the front surface 330, widening into fitting access space 315. The spill containment space/basin 302 is formed within the fitting access space 315. Rebar lifting rings 328 are provided in the top surface 334 so that the attachment interface 300 can be more easily lifted and placed into position by, for example, a fork-lift truck. Concave recesses 322 are integrally formed in interface body 304 by which to receive bollards (600, FIGS. 5A and 5B) that can be installed in the ground at a site to provide additional protection and stability to attachment interface 300.

Figure 3C:
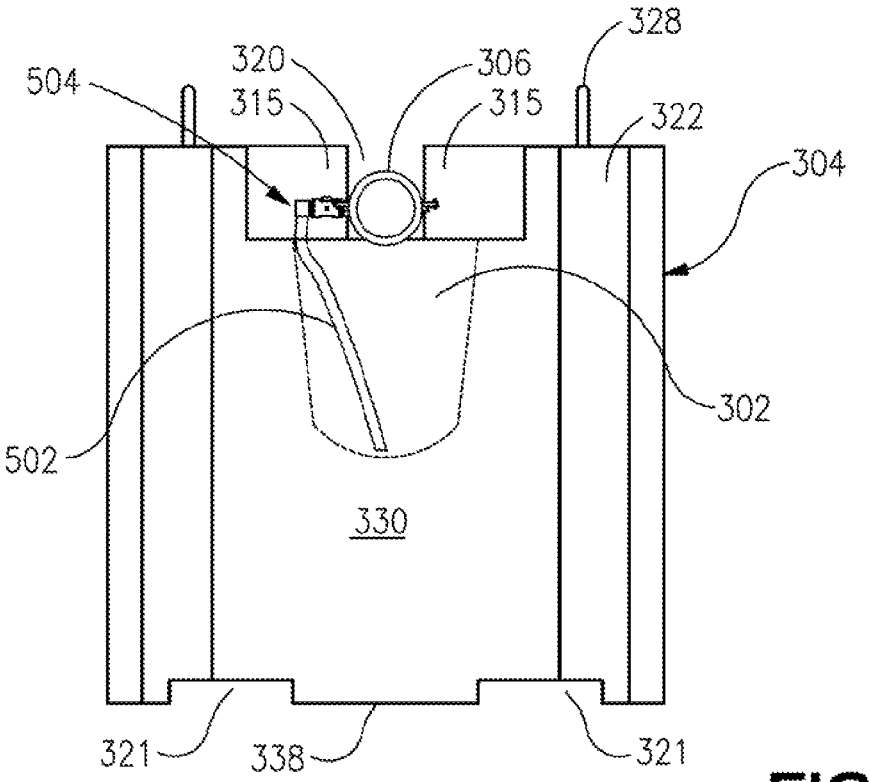
FIG. 3C is a front view of the first embodiment of the invention as viewed from the perspective of a pump truck operator.

FIG. 3C is a front view of an embodiment of the pump attachment interface 300 as viewed from the perspective of a pumping truck operator. This view shows a front surface 330 that extends from the ground to the top surface 334, and shows coupling 314 of the upper end 312 of conduit 306 as it would appear to a pump truck operator. The cover 350 (not shown) is unlocked, opened and hingedly rotated away from the top surface 334 to reveal the fitting 314 and the vacuum mechanism that can include vacuum control valve 504 and vacuum line 502. Spill containment space 302 is deep enough to permit easy access to fitting 314.

Figure 3D:
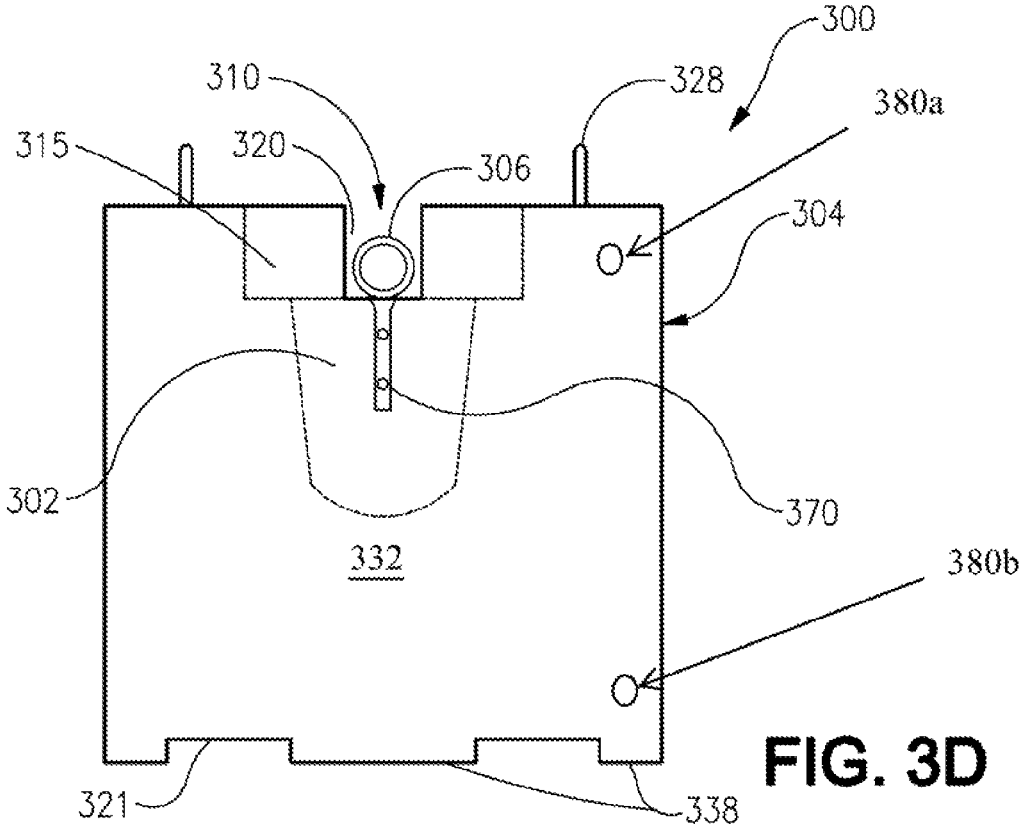
FIG. 3D is a backside view of the first embodiment of the invention.

FIG. 3D shows a backside view of attachment interface 300 that shows the back end 310 of conduit 306, and fitting 308 which is coupled to the line 104 that is disposed in the pit 102. Strap 370 is bolted to the back surface 332 and holds the conduit in place. Cover 350 is not shown for simplicity of illustration.

Figure 3E:
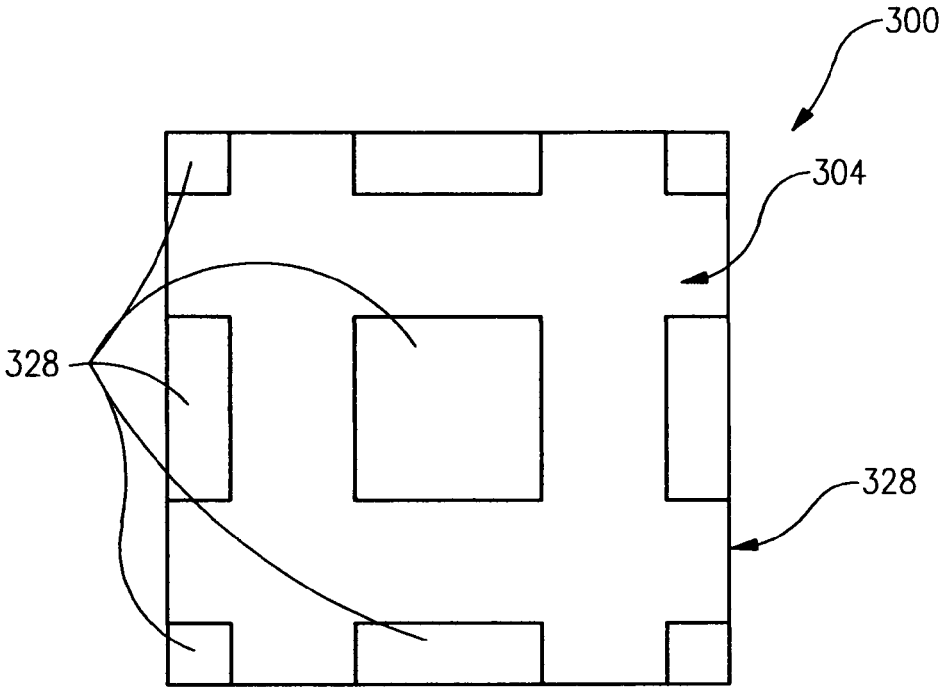
FIG. 3E is a plan view of the bottom surface of an embodiment of the invention.

FIG. 3E shows the bottom surface 338 of interface body 304. Lift channels 321 are integrally formed in bottom surface 338 to facilitate lifting of the attachment interface, such as by fork lift from all sides of the interface body. The lifting channels are dimensioned to receive standard sizes of fork lift blades.

Figure 4A:
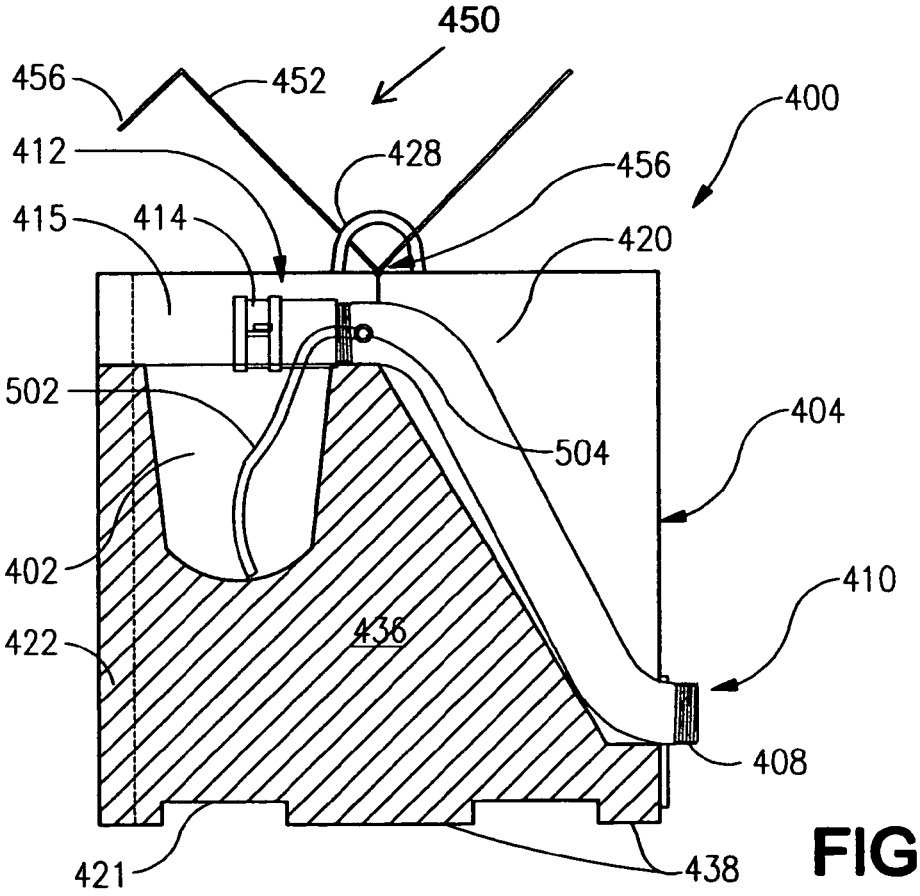
FIG. 4A is a side view of a second embodiment of the invention.

FIG. 4A is a diagram showing a side view of the second embodiment of the invention 400 (FIG. 1B). Interface body 404 has two side surfaces 436, a back surface 432, a top surface 434, a front surface (not shown). A conduit space 420 is formed integrally therein that has a width that is just slightly wider than the diameter of conduit 406 and extends from approximately where the conduit becomes horizontal at the front end 412, to approximately where the conduit 406 becomes horizontal and exits the back surface 432 of the interface body 404. The conduit space can be substantially rectangular in shape, or it can follow the angle of the conduit 406 as illustrated in the cross-sectional view of FIG. 4A.

In an embodiment, the interface body 404 can be a cement block consisting of approximately 1 cubic yard of six sack concrete with fibermesh and can weigh approximately 3300 pounds. The weight and mass of the attachment interface 400 therefore provides a stable platform that can serve to isolate the semi-permanently disposed first line 104 (FIG. 1) from being pulled by the operator or the operator's truck. Attachment interface 400 therefore also provides a stable and elevated target for the pump truck operator to back up to. The front end 412 of the conduit 406 is also at a height that provides easy access to the operator.

The sloping surface of conduit space 420 can be formed to support conduit 406 and is disposed inside of space 420 such that the conduit 406 is substantially located inside of interface body 404 as illustrated. This permits cover 450 to completely cover conduit 406 and to lie flush with top surface 434. In an embodiment, the conduit 406 can be made of a non-corrosive material such as aluminum. The conduit 406 can be of any suitable diameter, such as four inches for example.

In an embodiment, the width of the channel 420 can be just larger than the diameter of conduit 406 and the interface body 404 can be formed with the conduit 406 positioned therein. Clamping means 470 can be used to provide additional support at the back end 410 of conduit 406 (FIG. 4C). Thus, clamping means 470 can be any suitable structure that can be employed to retain conduit 406 within space 420, including a strap bolted to the back surface 432 of interface body 404, or brackets, ties, clamps, etc.

The benefit of the embodiment of FIG. 4A is that the back end 410 of conduit 406 exits back surface 432 at a lower position above the ground. This will place less stress on the coupling 408 when the line 104 is coupled thereto. As can be seen, the exit point of the back end 410 does not reach all the way to the ground 100, but ends at a point that is just above the ground 100. The exit point is of a height sufficient to elevate the back end 410 of conduit 406 above the ground 100 to make it easy to couple line 104 to fitting 408.

In an embodiment, the conduit 406 can have an elbow bend at an angle substantially equivalent to the angle of the sloping surface of space 420 such that the portion of back end 410 of conduit 406, after the elbow bend, is roughly parallel to the ground 100 as illustrated. This makes adapter fitting 408 more easily accessible for coupling to the first line 104, the other end of which is disposed in a pond or drill pit 102. This also ensures that the coupling is not at or too near the ground 100 upon which the interface body 404 rests.

In an embodiment, the front end 412 of conduit 406 extends from channel 420 into fitting access space 415 and over a spill containment space 402. Fitting access space 415 is deep enough to permit easy access to fitting 408 to facilitate coupling thereto, and allows front plate 452 of cover 450 to be flush and substantially even with top surface 434 when closed. Guard plate 456 is substantially the same length as the depth of the fitting access space 415 to thereby enclose the front of the fitting access space 415.

Spill containment space 402 is of sufficient size to either form a spill containment catch basin itself that is integrally formed within interface body 404, or to receive a spill containment catch component therein (not shown) that can be removably disposed under fitting 414 and within spill containment space 402 to catch any water that may spill from the pump line 103 as it is coupled and/or decoupled from the fitting 414. A catch basin component can be of any design, such as the "Pumpkin" spill containment system manufactured by Renegade Oilfield Products, LLC in Beaumont, Tex.

A vacuum line 502 is disposed into the catch basin 402 and is coupled to conduit 306 through a control valve 504. A truck operator can open the control valve 504 while pumping water through the conduit 406, into or out of pit 102, to create a vacuum that will vacuum out any water that has been collected into the basin through line 502 and into conduit 406. Thus, spillage of contaminated water into the catch basin 402 can be easily removed without it being necessary to handle the water in any way manually.

Figure 4B:
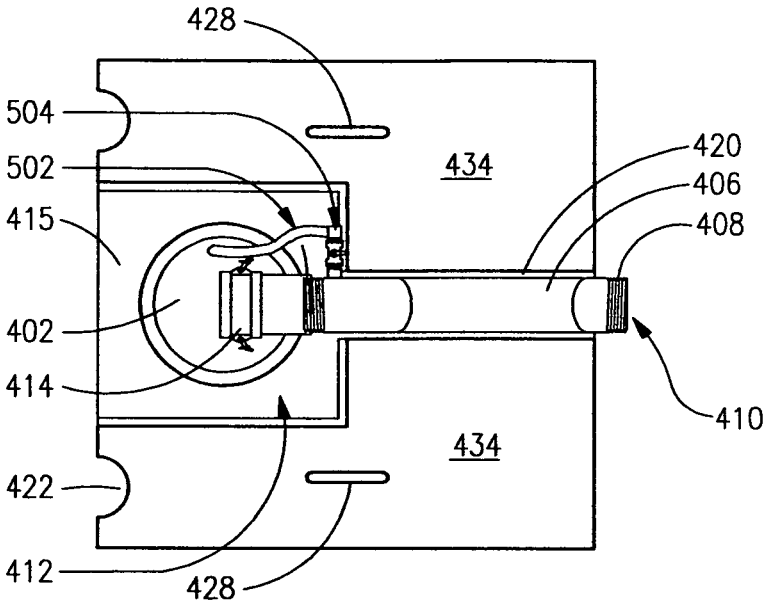
FIG. 4B is a plan view of the top of the second embodiment of the invention.
Figure 4C:
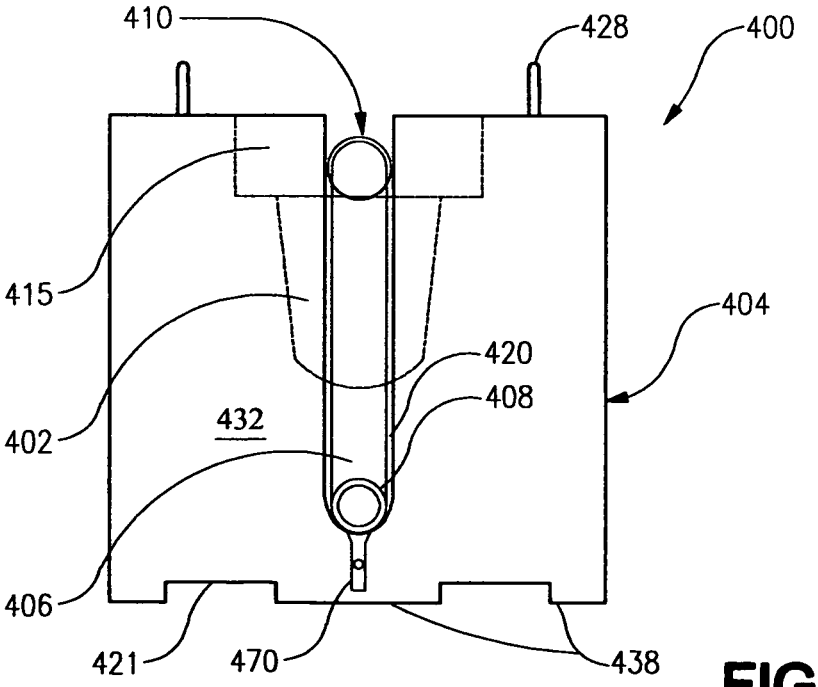
FIG. 4C is a front view of the second embodiment of the invention as viewed from the perspective of a pump truck operator.

FIG. 4B is a plan view of the top of attachment interface 400. The cover 450 has been removed for convenience of illustrating the components therein. Interface body 404 is shown, having top surface 434. The conduit space 420 starts at the back surface 432 of the interface body 404 and runs toward the front surface 430, widening into fitting access space 415. The spill containment space/basin 402 is formed within the fitting access space 415. Rebar lifting rings 428 are provided in the top surface 434 so that the attachment interface 400 can be more easily lifted and placed into position by, for example, a fork-lift truck. Concave recesses 422 are integrally formed in interface body 404 by which to receive bollards (600, FIGS. 5A and 5B) that can be installed in the ground at a site to provide additional protection and stability to attachment interface 400.

FIG. 4C shows a backside view of attachment interface 400 that shows the back end 410 of conduit 406, and fitting 408 which is coupled to the line 104 that is disposed in the pit 102. Strap 470 is bolted to the back surface 432 and holds the conduit 406 in place. Cover 450 is not shown for simplicity of illustration.

It should be noted that the front view of attachment interface 400 is virtually identical to that of attachment interface 300 as illustrated in FIG. 3C. Further, the bottom surface of attachment interface 400 is virtually identical to the bottom surface of attachment interface 300 as illustrated in FIG. 3E.

Figure 5A:
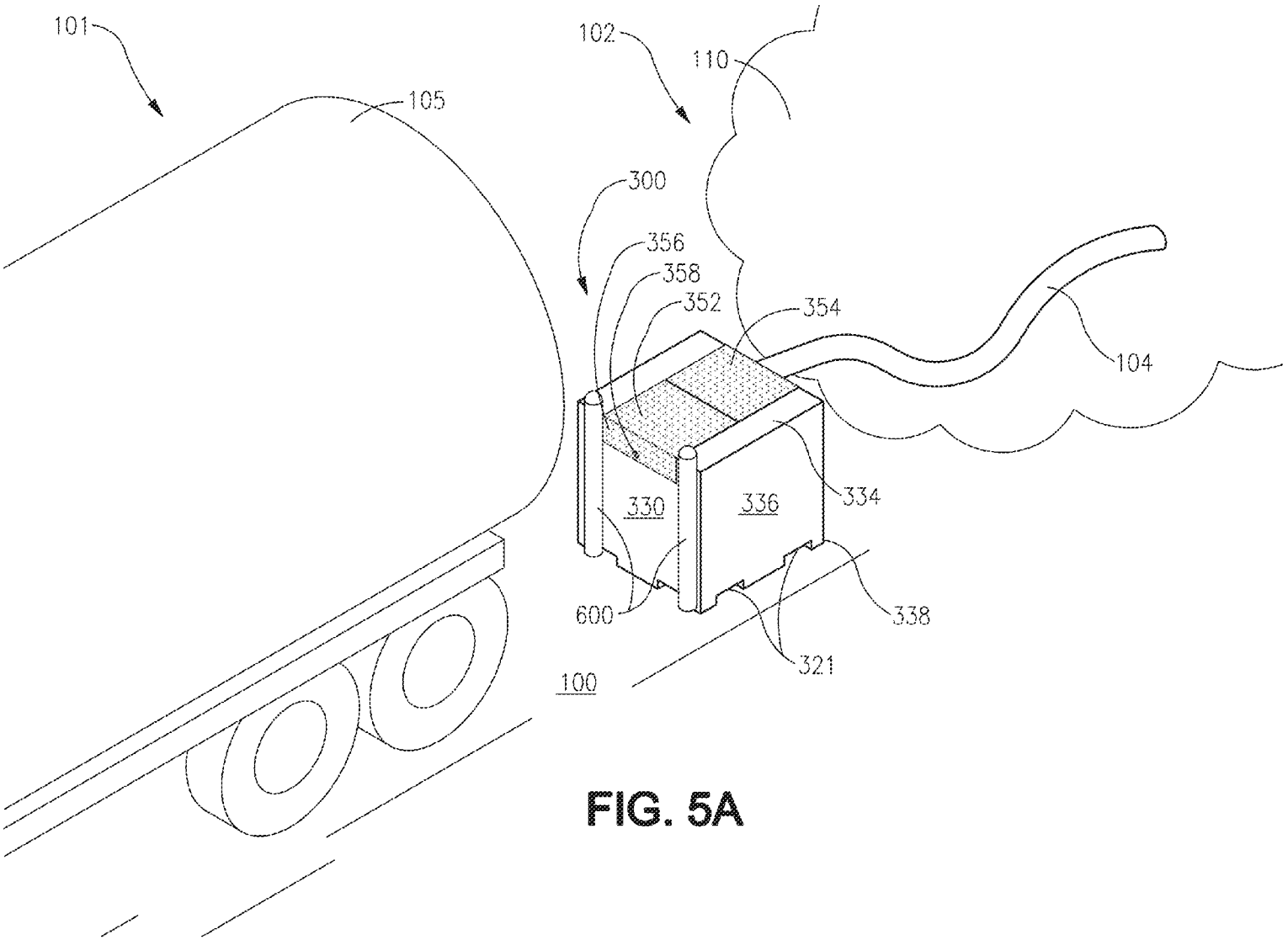
FIG. 5A is a perspective view showing a pump truck backing up to an embodiment of the invention that is closed and locked.

FIG. 5A shows a scenario where a pump truck is backing up to attachment interface 300, which is closed and locked. Bollards 600 are disposed in the ground 100 and attachment interface body 304 is placed against bollards 600, which are received by concave recesses 322 (hidden, but shown in FIGS. 3A, 3B, 3C and 3D). It will be appreciated that attachment interface embodiment 400 is completely interchangeable with attachment interface embodiment 300 as shown.

Figure 5B:
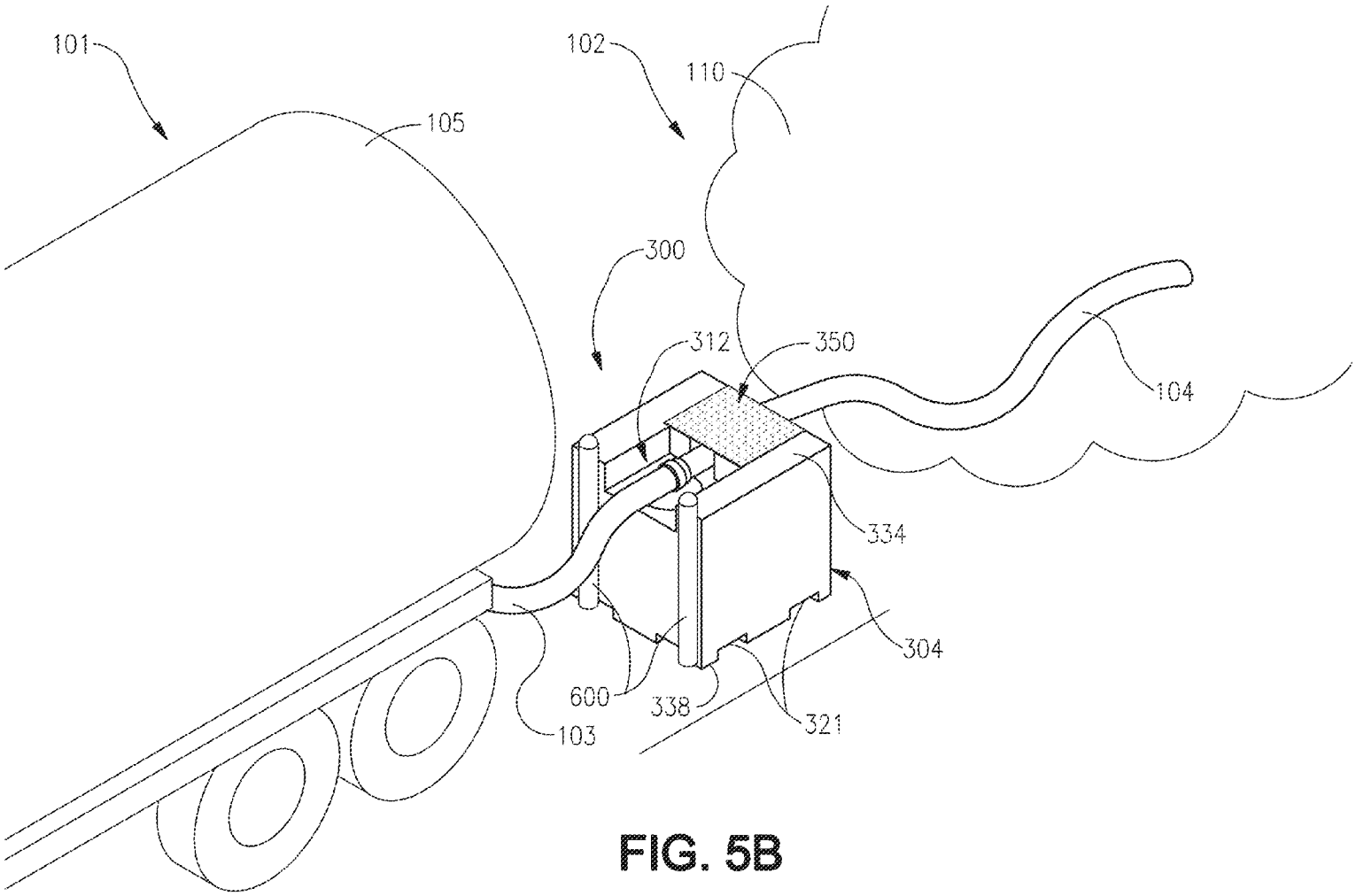
FIG. 5B is a perspective view showing a pump truck that has been coupled to an embodiment of the invention that has been unlocked and opened.

FIG. 5B shows a scenario where a truck operator has opened cover 350 by unlocking the locking mechanism 358, and rotating open front plate 552 and front guard 358 to expose the front end 312 of conduit 306. Pump line 103 is attached to fitting 314. It will be appreciated that attachment interface embodiment 400 is completely interchangeable with attachment interface embodiment 300 as shown.

Other modifications and implementations will occur to those skilled in the art without departing from the spirit and the scope of the invention as claimed. Accordingly, the above description is not intended to limit the invention except as indicated in the following claims.

What is claimed is:

1. A portable pump attachment interface for providing a fixed link between a first line having a remote end that is in direct communication with a fluid reservoir and a second line in communication with a mobile storage tank via a pumping mechanism, the interface comprising:

an interface body having a substantially rectangular shape and having a bottom surface for resting upon a top surface of the ground;

a conduit supported by the interface body to elevate and support the entire conduit above the ground, a back end of the conduit configured to be detachably coupled to the first line, and a front end of the conduit configured to be detachably coupled to the second line; and a spill containment catch basin formed below and in communication with a fitting access space, the fitting access space being formed within a top surface of the interface body, the front end of the conduit being disposed over the spill containment catch basin and disposed within the fitting access space, wherein the interface body is configured to be portably relocated from one location to another, while having sufficient mass by which to substantially isolate the first line from pulling forces exerted on the second line that would otherwise be of sufficient magnitude to reach the remote end, the substantial isolation being provided when the lines are attached to the conduit and the interface body is resting freely upon the top surface of the ground.

2. The pump attachment interface of claim 1 wherein the interface body is made of solid concrete.

3. The pump attachment interface of claim 1 further comprising a vacuum mechanism coupled between the conduit and the catch basin for removing spillage from the catch basin.

4. The pump attachment interface of claim 3 wherein the vacuum mechanism includes a vacuum valve coupled between the conduit and a vacuum line disposed in the catch basin, the flow of liquid through the conduit causing a vacuum within the vacuum line when the vacuum valve is open.

5. The pump attachment interface of claim 1 wherein the conduit is angled and supported by a sloping surface within a conduit space integrally formed within the sloping surface so that the front end of the conduit is at a higher level above the ground than the back end of the conduit.

6. The pump attachment interface of claim 1 wherein the interface body is made of hollow molded plastic and is configured to be filled with a weighting material to establish the sufficient mass.

7. The pump attachment interface of claim 1 wherein the conduit is substantially straight and supported by a conduit channel formed within the top surface of the interface body so that the front end of the conduit is at substantially the same height above the ground as the back end of the conduit.

8. The pump attachment interface of claim 1 wherein the spill containment catch basin is integrally formed with the interface body.

9. The pump attachment interface of claim 1 further comprising a conduit cover that encloses the fitting access space when closed.

10. The pump attachment interface of claim 9 wherein the conduit cover includes a locking mechanism to prevent unauthorized access to the fitting access space and the front end of the conduit.

11. The pump attachment interface of claim 10 wherein the conduit cover includes a hinge between a first and a second plate, the first plate and second plate capable of being hingedly opened independently of the other.

12. The pump attachment interface of claim 1 wherein the bottom surface of the interface body includes lift channels for receiving fork lift blades on each side of the interface body.

13. The pump attachment interface of claim 1 wherein a front end surface of the interface body includes at least one recess for receiving a bollard that is disposed in the ground upon which the bottom surface of the interface body rests, to substantially isolate the first line from pulling forces exerted on the second line.

14. A portable pump attachment interface for providing a fixed link between a first line in communication with a fluid reservoir and a second line in communication with a mobile storage tank via a pumping mechanism, the interface comprising:

an interface body having a substantially rectangular shape and having a bottom surface for resting upon the ground;

a conduit supported by the interface body to elevate and support the entire conduit above the ground, a back end of the conduit configured to be coupled to the first line, and a front end of the conduit configured to be coupled to the second line, the conduit being disposed in a conduit space that is integrally formed within the interface body, the conduit space in communication with a fitting access space integrally formed in a top surface of the interface body;

a spill containment catch basin integrally formed within the interface body and disposed under the fitting access space, the front end of the conduit being disposed over the spill containment catch basin and within the fitting access space; and a cover having a front plate, a guard plate and back plate, the cover fixedly attached to the top surface of the interface body at a hinge point between the front and back plates, the front plate and guard plate for completely covering the fixture access space, wherein the interface body is of sufficient weight by which to substantially isolate the first line from pulling forces exerted on the second line.

15. The pump attachment interface of claim 14 wherein the interface body is made of hollow molded plastic and is configured to be filled with a weighting material such that the interface body has sufficient weight to substantially isolate the first line from pulling forces exerted on the second line.

16. The pump attachment interface of claim 15 wherein a front end surface of the interface body includes at least one recess for receiving a bollard that is disposed in the ground upon which the bottom surface of the interface body rests to further isolate the first line from pulling forces exerted on the second line.

17. The pump attachment interface of claim 16 wherein the interface body has a first plug through which the weighting material may be introduced into the interface body, and a second plug through which the weighting material may be removed from the interface body.

18. The pump attachment interface of claim 14 further comprising a vacuum mechanism coupled between the conduit and the catch basin for removing spillage from the catch basin, the vacuum mechanism including a vacuum valve coupled between the conduit and a vacuum line disposed in the catch basin, the flow of liquid through the conduit causing a vacuum within the vacuum line when the vacuum valve is open.

19. The pump attachment interface of claim 14 wherein the conduit is angled and supported by a sloping surface within the conduit space so that the front end of the conduit is at a higher level above the ground than the back end of the conduit.

20. The pump attachment interface of claim 14 wherein the conduit is substantially straight and the conduit space is a conduit channel formed within the top surface of the interface body so that the front end of the conduit is at substantially the same height above the ground as the back end of the conduit.

* * * * *